United States Patent [19]

Justus

[11] Patent Number: 4,903,567

[45] Date of Patent: Feb. 27, 1990

[54] GUITAR WITH DUAL SOUND CHAMBERS

[76] Inventor: Wilbur J. Justus, 209 S. Factory St., Fairmount, Ind. 46928

[21] Appl. No.: 312,495

[22] Filed: Feb. 21, 1989

[51] Int. Cl.[4] ..... G10D 3/02

[52] U.S. Cl. ..... 84/294; 84/291

[58] Field of Search ..... 84/268, 270–271, 84/275–277, 284–285, 291–292, 294–296

[56] References Cited

U.S. PATENT DOCUMENTS

| | | | |
|---|---|---|---|
| 1,001,302 | 8/1911 | Rauch | 84/291 |
| 1,510,019 | 9/1924 | Slingerland | 84/271 |
| 1,887,861 | 11/1932 | Schireson | 84/294 |
| 4,090,427 | 5/1978 | Kaman | 84/291 |
| 4,161,130 | 7/1979 | Lieber | 84/267 |
| 4,206,678 | 6/1980 | Guerrero | 84/267 |

FOREIGN PATENT DOCUMENTS

| | | | |
|---|---|---|---|
| 271064 | 3/1914 | Fed. Rep. of Germany | 84/294 |

*Primary Examiner*—Lawrence R. Franklin
*Attorney, Agent, or Firm*—Roger M. Rickert

[57] ABSTRACT

A guitar is formed with a one-piece molded fiberglass body having nested oppositely facing inner and outer concavities. A sound board is bonded to one side of the body to enclose the outer concavity and a substantially smaller back is bonded to the other side of the body to enclose the smaller concavity. The inner concavity has a peripheral rim which is recessed to receive the back allowing the back and exterior of the body to be uniformly coated to give the appearance of blending together as a single piece. An optional sound transmitting post may extend between the back and a central portion of the inner concavity. The inner concavity is provided with small openings or f-holes for sound communication between the concavities and the sound board has the conventional central opening.

10 Claims, 2 Drawing Sheets

GUITAR WITH DUAL SOUND CHAMBERS

SUMMARY OF THE INVENTION

The present invention relates generally to the construction of musical instruments and more particularly to the construction of a plucked string musical instrument such as a guitar having multiple sound cavities.

Traditionally, stringed musical instruments such as guitars, violins, cellos and the like have been fabricated by hand almost entirely from wood by highly skilled craftsmen. With increasing labor costs, such hand made instruments are too expensive for the average amateur or casual student musician. The time honored technique is to form a wooden sidewall into a somewhat serpentine pear-shape which is subsequently held in that pear-shape by cross struts. A front sound board and a back of similar size and shape are fastened to the formed side. Forming of the side portion is time consuming and expensive, and, if not properly formed and subsequently braced, the side may ultimately warp severely damaging or ruining the instrument. Several attempts have been made to automate production of these instruments including attempts to fabricate the main body of the instrument by molding or similar techniques. For example, in U.S. Pat. No. 3,656,395 the body of a guitar was formed of a one-piece curved bowl of fiberglass material forming the back and sides of the body and a flat wooden soundboard adhered to the fiberglass to form the top of the body. U.S. Pat. No. 4,161,130 suggests a bowl shaped body formed in a single piece of graphite, fiberglass or impregnated fabric with a transverse waist separating a smaller upper bowl portion from a larger lower bowl portion. Similar attempts have been made in the world of electronic stringed instruments such as an electronic guitar. In U.S. Pat. No. 4,359,923, the entire body, neck, head and tail piece are formed as a single metal casting. Of course, the design considerations in electronic stringed instruments are quite different from those in the traditional stringed instrument. None of these attempts have yielded a particularly desirable sound, nor have they met with much commercial success.

Among the several objects of the present invention may be noted the provision of a simplistic technique for fabricating the body of a traditional stringed instrument; the elimination of the conventional formed wooden side and associated cross struts normally found in stringed musical instruments; the provision of a unique guitar design of enhanced tonal qualities and reduced manufacturing cost; the provision of a body for a plucked string instrument having two resonant cavities coupled together; and the provision of overall improvements and simplification of the fabrication techniques for a guitar having two (or more) resonant cavities rather than the conventional single cavity. These as well as other objects and advantageous features of the present invention will be in part apparent and in part pointed out hereinafter.

In general, a body for a guitar or similar stringed instrument is formed as a molded one-piece fiberglass member having nested oppositely opening concavities each terminating in a generally planar rim for receiving a flat cavity enclosing board. One of the concavities is somewhat annular in shape and forms a moat encircling the other concavity. The other or encircled cavity is provided with a plurality of small openings for providing air pathways between the concavities.

Also in general and in one form of the invention, a guitar or similar plucked string instrument has a body portion with at least two distinct sound chambers and is formed of a contoured molded member forming the body side and having first and second spaced apart generally planar rims for receiving a relatively flat sound board and a relatively flat back respectively. The sound board and back thus function to cooperate with the contoured member to complete their respective sound chambers. The sound board has a centrally located air passing opening and a periphery mateable with the first rim, and the back is opening-free and has a periphery mateable with the second rim. The sound board and back are made of wood with the sound board periphery being substantially longer than the periphery of the back. A wooden sound post passes through one of the sound chambers and mechanically couples a central portion of the back with a central portion of the contoured molded member.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
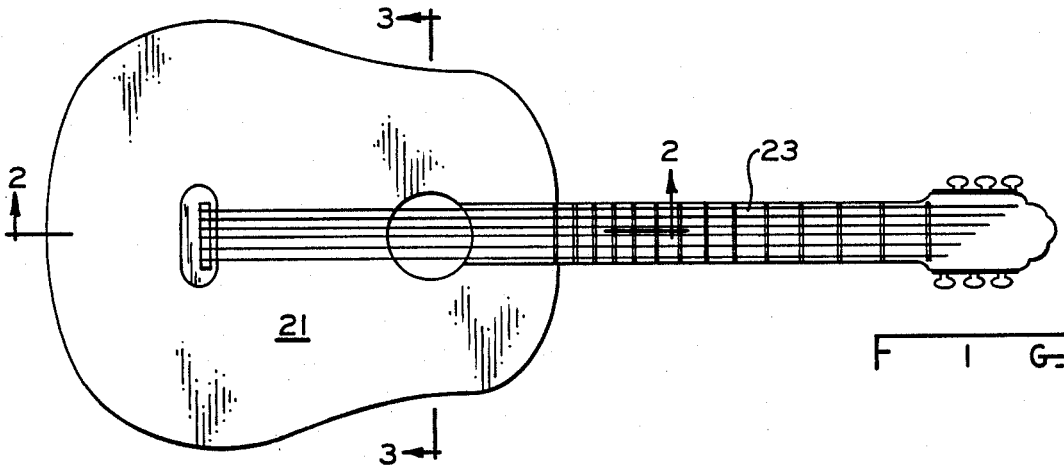
FIG. 1 is a plan view showing the front of a guitar incorporating the invention in one form.
Figure 2:
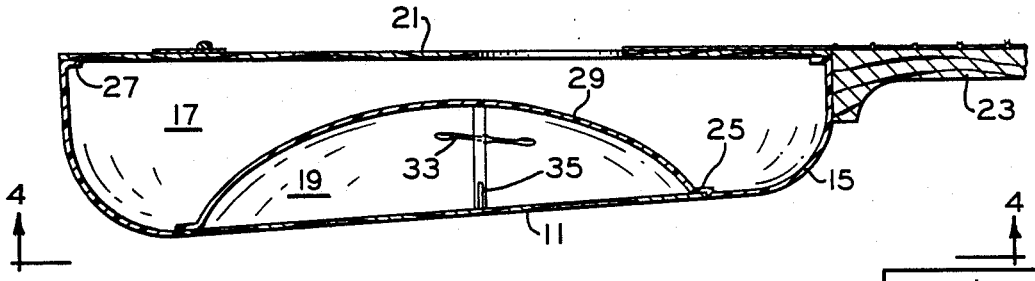
FIG. 2 is a view in cross-section along the line 2—2 of FIG. 1.
Figure 3:
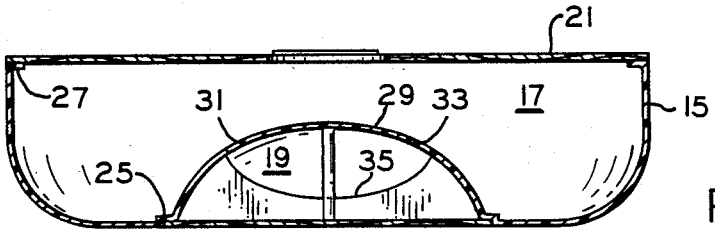
FIG. 3 is a view in cross-section along the line 3—3 of FIG. 1.
Figure 4:
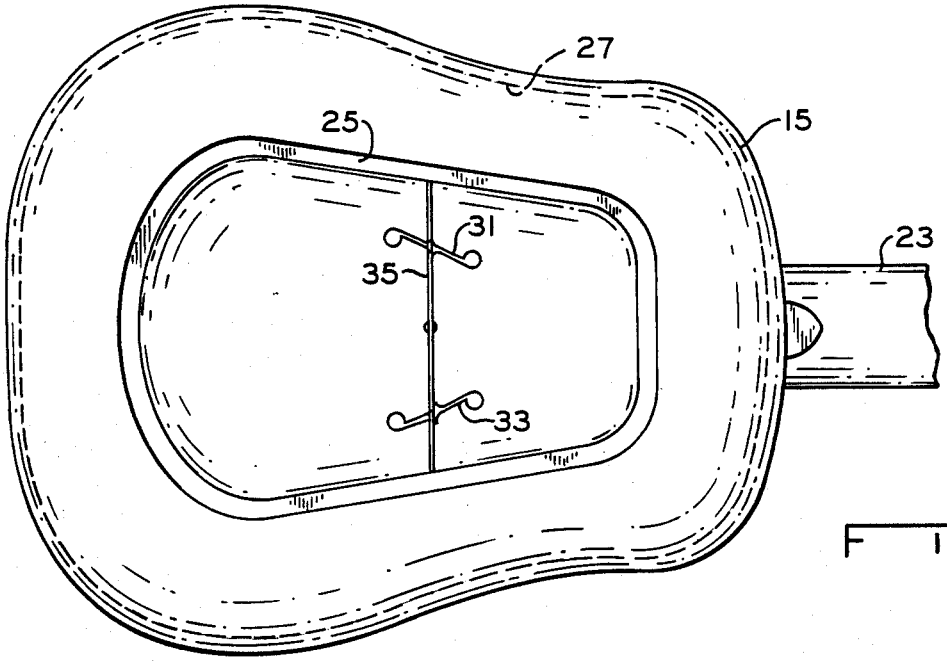
FIG. 4 is a bottom view along line 4—4 of FIG. 1 with the back removed.

In FIG. 1 there is shown a guitar having a somewhat conventional neck 23 and head (not shown) and also having a one piece molded fiberglass body 15 with a rim 27 to which the front or sound board 21 of the guitar is fastened. The sound board 21 and body 15 define therebetween a first resonant cavity 17. A flat piece or back 11 is fastened to the back face of the fiberglass body 15, for example, by bonding the back to the recessed rim or ledge 25, to enclose the second resonant cavity 19. A sound post 13 for transmitting vibrations between the back 11 and the portion of the body 15 which forms a barrier 29 between cavities or chambers 17 and 19 is interposed as the back 11 is bonded to the bottom or rear face of the body. A pair of "S" shaped openings 31 and 33 (commonly called f-openings) provide communication between the two cavities. It will be noted that the maximum depth of the cavity 19 is less than the maximum depth of the cavity 17 and greater than one-half the maximum depth of that cavity.

The process of fabricating such a stringed musical instrument begins with the molding of the contoured fiberglass body portion to have a pair of nested oppositely opening cavities 17 and 19 with the cavity 17 encircling the other cavity 19 like a moat. Each cavity has a generally flat outer peripheral rim 25 or 27 for receiving a corresponding generally flat wooden member 11 or 21 with rim 25 formed as a ledge or recess at the same depth as the thickness of back 11. The two cavities are then enclosed by bonding a generally flat sound board 21 to the one cavity rim 27 and bonding a generally flat back 11 to the recessed cavity rim 25. A neck portion 23 may then be bonded to both the sound board 21 and the body portion 15 and the instrument finished as desired including uniformly coating the back and the exterior portion of the body so that the back blends imperceptibly into the body. Prior to enclosing the smaller cavity 19, a vibration transmitting sound post 13 may optionally be interposed between the back 11 and the peak of the smaller cavity. Completion of the instrument then proceeds in substantially the conventional way.

Figure 5:
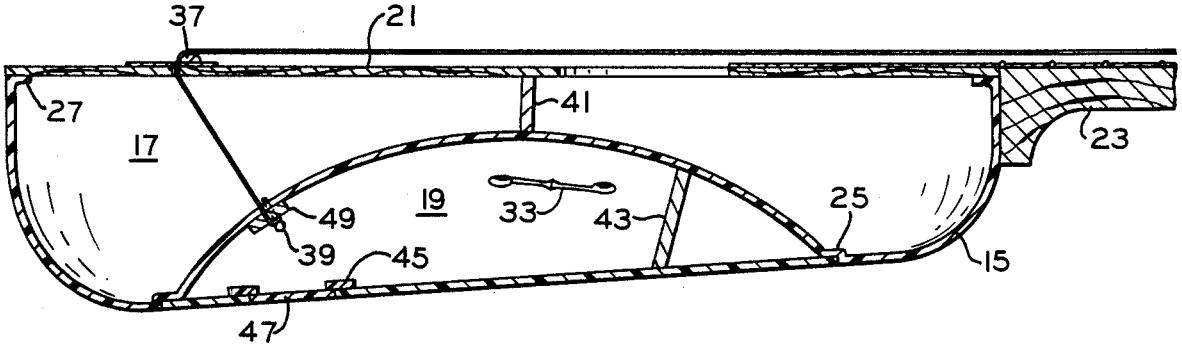
FIG. 5 is a view in cross-section similar to FIG. 2, but illustrating a modification in accordance with the present invention.

In FIG. 5, it will first be noted that there are two sound posts; 41 coupling the front or face 21 with the contoured portion of the body 15, and 43 coupling the contoured portion with the back. The back is made of plastic or fiberglass in FIG. 5 and includes a snap-off cover 47 which normally rests on ledge 45. This cover 47 gives access to the string tightening pins 39. It will be noted that the strings now pass over the bridge 37 and into the interior of the instrument to connect to pins 39 of a metal string holder 49 which is bonded to the contoured portion of the body. Thus, string vibrations are more directly coupled, as if by another sound post, to the body portion which divides the instrument interior into the two cavities 17 and 19.

In summary, the present invention provides a one piece molded fiberglass or similar body for a guitar or similar plucked or bowed stringed instrument where the sound board fastens to one side of the body defining one resonant cavity and the smaller back fastens to the other side of the body forming a second resonant cavity which is located generally centrally within the other resonant cavity. The smaller back is bonded to a recessed rim so that the back is level with the rest of the body and may be uniformly finished so that the joint between the body and back is imperceptible. When thus finished, the completed guitar appears as a conventional pear-shaped guitar except for the fact that the dome of the smaller cavity or sound chamber and the f-holes may be seen through the hole in the front sound board.

From the foregoing, it is now apparent that a novel guitar having improved sound and ease of fabrication has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A guitar or similar plucked string instrument having a body portion with at least two distinct sound chambers and comprising a contour molded one piece fiberglass member having nested oppositely opening concavities each terminating in first and second spaced apart generally planar rims for receiving a relatively flat sound board and a relatively flat back respectively, a relatively flat sound board having a centrally located air passing opening and a periphery mateable with the first rim, and a relatively flat opening-free back having a periphery mateable with the second rim.

2. The instrument of claim 1 wherein the sound board and back are made of wood with the sound board periphery being substantially longer than the periphery of the back.

3. The instrument of claim 2 further comprising a wooden sound post passing through one of the sound chambers and mechanically coupling a central portion of the back with a central portion of the contoured molded member.

4. The instrument of claim 1 wherein the contoured molded member is formed as a molded one-piece fiberglass member having nested oppositely opening concavities each having a periphery terminating in a corresponding one of said rims, one of the concavities being somewhat annular in shape and encircling the other concavity.

5. The instrument of claim 4 wherein said other concavity is provided with a plurality of small openings for providing air pathways between the concavities.

6. The instrument of claim 5 wherein the maximum depth of said other concavity is less than the maximum depth of said one concavity and greater than one-half the maximum depth of said one concavity.

7. The method of fabricating a stringed musical instrument comprising the steps of;

molding a contoured fiberglass body portion to have a pair of nested oppositely opening cavities with one of the cavities encircling the other of the cavities like a moat and with each cavity having a generally flat outer peripheral rim;

enclosing said one cavity by bonding a generally flat sound board to the one cavity rim;

enclosing said other cavity by bonding a generally flat back to the other cavity rim;

affixing a neck portion to both the sound board and the body portion; and uniformly coating the back and the exterior portion of the body.

8. The method of claim 7 wherein the step of enclosing the other cavity includes the step of interposing a vibration transmitting sound post between the back and the other cavity.

9. The method of claim 8 including the additional step of interposing a second sound post intermediate the sound board and the fiberglass body portion within said one cavity.

10. The method of claim 7 including the step of extending the strings of the instrument over a bridge and into the interior of the instrument to terminate at the fiberglass body within said one cavity.

* * * * *